United States Patent [19]

Couwenberg

[11] 4,208,604

[45] Jun. 17, 1980

[54] LOW-PRESSURE MERCURY VAPOR DISCHARGE LAMP

[75] Inventor: Winston D. Couwenberg, Eindhoven, Netherlands

[73] Assignee: U.S. Philips Corporation, New York, N.Y.

[21] Appl. No.: 934,684

[22] Filed: Aug. 18, 1978

[30] Foreign Application Priority Data

Aug. 23, 1977 [NL] Netherlands ..... 7709266

[51] Int. Cl.[2] ..... H01J 5/16; H01J 61/32; H01J 61/42

[52] U.S. Cl. ..... 313/113; 313/220; 313/493; 362/216; D26/2

[58] Field of Search ..... 313/493, 485, 220, 113; 362/216, 225, 247, 237, 260, 263; D48/33, 34

[56] References Cited

U.S. PATENT DOCUMENTS

| | | | |
|---|---|---|---|
| D. 113,357 | 2/1939 | Babb | D48/33 |
| D. 113,550 | 2/1939 | Clark | 362/216 X |
| D. 113,652 | 3/1939 | Bilofsky | D48/33 |
| 673,277 | 4/1901 | De Marcay | 362/225 |
| 1,774,842 | 9/1930 | Peters | 362/216 |
| 1,857,120 | 5/1932 | Transom | 313/113 X |
| 1,870,147 | 8/1932 | Smally | 362/260 X |
| 3,775,609 | 11/1973 | Dank | 362/263 |
| 3,953,761 | 4/1976 | Lo Givdice | 362/216 X |

*Primary Examiner*—Palmer C. Demeo
*Attorney, Agent, or Firm*—Robert S. Smith

[57] ABSTRACT

Low-pressure mercury vapor discharge lamp comprising an U-shaped discharge tube of which at least the legs are accommodated in recesses of a cylindrical body.

4 Claims, 5 Drawing Figures

LOW-PRESSURE MERCURY VAPOR DISCHARGE LAMP

The invention relates to a low-pressure mercury vapor discharge lamp comprising at least one U-shaped discharge tube.

German patent specification No. 837,892 describes such a lamp as being suitable for use in luminaires for incandescent lamps for general illumination purposes. In this German patent specification the U-shaped discharge tube is enclosed by an outer bulb which is in the form of an envelope of an incandescent lamp, the lamp base being of a type customary for incandescent lamps. In this prior art lamp an inductive stabilization ballast is present in the lamp base. A drawback of the lamp described in the above-mentioned German patent specification is, that, by enclosing the U-shaped discharge tube in an outer bulb, the temperature in the discharge tube increases to such a value that the critical vapor pressure for an optimum conversion of electric power into ultraviolet radiation can easily be exceeded. As a consequence the efficiency of the lamp and the electric power consumed by the lamp decrease.

It is an object of the invention to provide a low-pressure mercury vapor discharge lamp which does not have the above-mentioned drawbacks.

A low-pressure discharge lamp of the type mentioned in the preamble is characterized in accordance with the invention, that the lamp comprises an, at least for the greater part, cylindrical body having recesses, wherein at least each of the legs of the discharge tube are accommodated over its circumference over an angle of at least 150°.

A lamp according to the invention is easy to handle owing to its cylindrical geometry. Provided with a suitable lamp base in which a glow discharge starter and an electric stabilization ballast are disposed such a lamp can be used for screwing into luminaires for incandescent lamps for general illumination purposes. When accommodating the discharge tube over its circumference over an angle exceeding 150° the force which is exercised on the discharge tube itself during screwing is low; this force is, namely, absorbed by the cylindrical body. It is also possible to secure the cylindrical body to the lamp base by means of a suitable glue. Accordingly the risk of fracturing the discharge tube is small. Furthermore, in a lamp according to the invention the temperature in the discharge tube is adversely affected to the least possible degree because a relatively large portion of the discharge tube wall is in contact with the cool environment.

The cylindrical body is preferably transmissive to light; the loss of light is then low. The cylindrical body consists, for example, of a solid transparent synthetic resin material, such as polished "Perspex" (trade name). In such a cylindrical body the recesses for the discharge tube can be applied in a simple manner.

In a further embodiment of the lamp according to the invention the cylindrical body is hollow. This has the advantage that the weight of the lamp is as low as possible. In addition, there is room in the body for applying an inductive stabilization element and/or a glow discharge starter. In that case it is not necessary to provide additional provisions in the incandescent lamp luminaire itself for the electric units. The wall of such a hollow cylindrical body consists, for example, of a synthetic resin material; the hollow body can be produced in a simple manner by moulding such as injection moulding.

The light output of a lamp according to the invention can be increased by providing the wall of the recesses in the cylindrical body, which faces the discharge tube, with a reflecting layer. An example of such a layer is a vacuum-deposited metal layer, such as aluminium.

Lamps according to the invention are an excellent alternative for incandescent lamps. For, not only the dimensions of lamps according to the invention are substantially the same as those of incandescent lamps but, in addition, the efficiency of the discharge lamps is a few times greater. By a suitable choice of the luminescent material a color temperature can be achieved with low-pressure mercury vapor discharge lamps according to the invention which is equal to that of the incandescent lamp; this makes the use of the small discharge lamps according to the invention attractive for use in living rooms.

The invention will be further explained with reference to a drawing.

In the drawing

Figure 1:
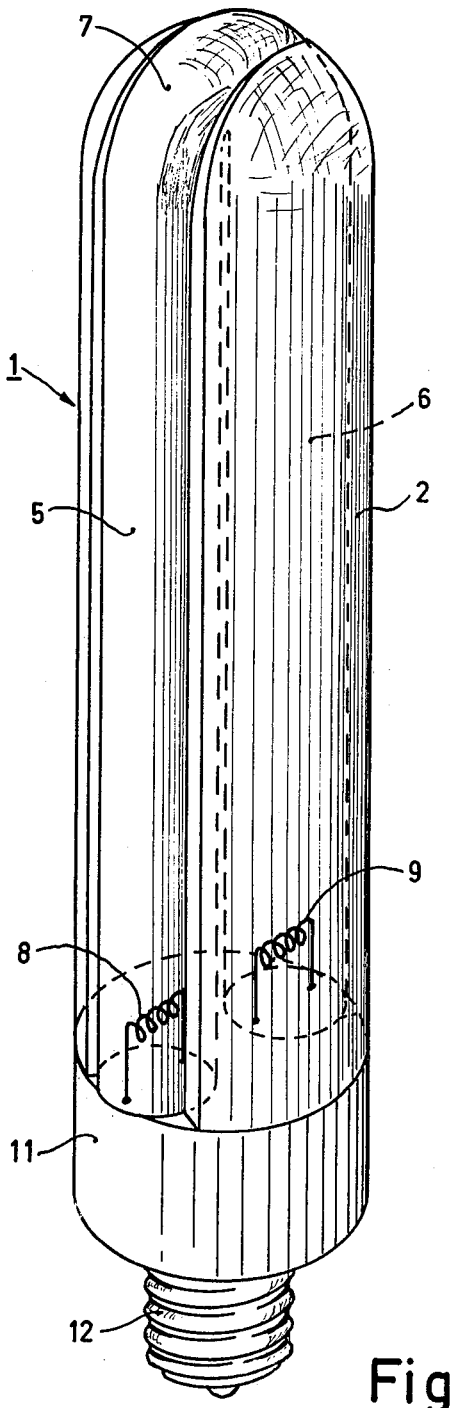
FIG. 1 shows an embodiment of a low-pressure mercury vapor discharge lamp according to the invention.
Figure 2:
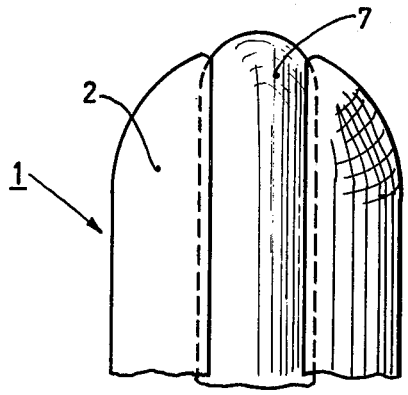
FIG. 2 shows a perspective view of an upper portion of the lamp shown in FIG. 1

In FIGS. 1 and 2 a low-pressure mercury vapor discharge lamp is indicated by 1. This lamp comprises a cylindrical solid body 2, consisting of a suitable transparent synthetic resin material, such as, for example, polished "Perspex" (trade name). The cylindrical body 2 comprises two diametrically opposite recesses 3 and 4 respectively (see FIG. 3) which extend in the longitudinal direction and in which the legs 5 and 6 respectively of the U-shaped discharge tube are accommodated along the circumference over an angle of approximately 200°. The bent portion 7 of the discharge tube is also accommodated in a recess in the cylindrical body. In order to affect the light distribution of the lamp favorably it is possible to give the outside of the recesses a slightly wedge-shaped form (*3a*). The electrodes 8 and 9 are disposed at the ends of the legs of the discharge tube. The inner wall of the discharge tube is provided with a luminescent coating 10 (see FIG. 3), consisting of a mixture of phosphors, namely blue luminescent bivalent europium-activated barium magnesium aluminate, green luminescent terbium-activated cerium magnesium aluminate and red luminescent trivalent europium-activated yttrium oxide. The tube is filled with mercury vapor and a rare gas or combination of rare gases. The end of the lamp comprises a lamp base 11, which is provided with a sleeve 12 with screw threads. The cylindrical body is secured to this lamp base by means of a glue. An inductive stabilization element can be disposed in the lamp base. Furthermore, there is the possibility of fitting a glow discharge starter in the sleeve or in the lamp base. The length of the entire lamp, so including the lamp base, is approximately 18 cm. The diameter or the lamp, that is to say the diameter of the cylindrical body is approximately 3.5 cm. The inside diameter of the discharge tube is approximately 1.0 cm. At an applied power of 10 W and an argon pressure of 3 torr the total luminous flux of the lamp is 750 lm.

Figure 3:
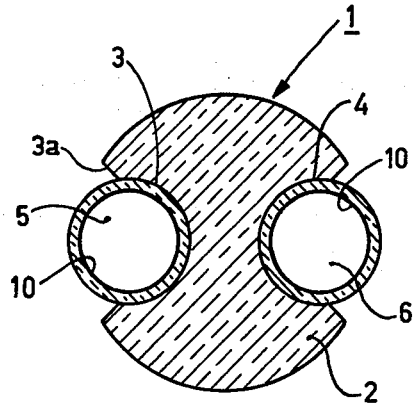
FIG. 3 shows a cross-section of a lamp shown in FIG. 1.

FIG. 3 shows a cross-section of a lamp shown in FIG. 1. The numerals refer to the same components as in FIG. 1.

Figure 4:
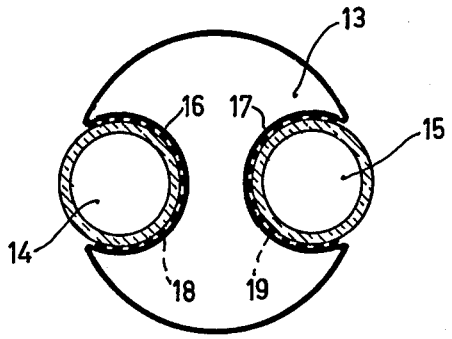
FIG. 4 shows a cross-section of a low-pressure mercury vapour discharge lamp according to the invention, the body being hollow.

FIG. 4 shows a cross-section of an embodiment of a low-pressure mercury vapor discharge lamp according to the invention wherein the cylindrical body 13, in which the U-shaped discharge tube is disposed, is hollow. The wall consists of a synthetic resin material, which, for example, contains a polycarbonate. The wall thickness is approximately 2 mm. The legs of the U-shaped discharge tube are indicated by 14 and 15. The inner sides of the wall of the recesses 16 and 17 which face the discharge tube are coated with a layer of reflective material 18 and 19 respectively, such as a vacuum-deposited aluminium layer. In that case, by connecting an end of the aluminium layer via a resistor to a lead of an electrode, the reflecting layer can also be used for facilitating starting of the lamp. A stabilisation element and/or a glow discharge starter can be disposed in the hollow room within the cylindrical body. Alternatively, it is possible to place a rod or tube, whose wall is provided with reflecting material in the hollow part of the cylindrical body instead of reflecting layers 18 and 19. The dimensions of the lamp are the same as of the lamp shown in FIGS. 1 and 2.

Figure 5:
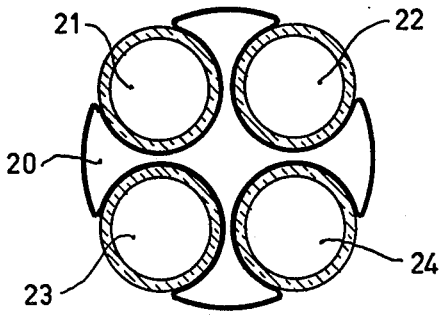
FIG. 5 shows an embodiment of a low-pressure mercury vapour discharge lamp wherein two U-shaped discharge tubes are disposed in the cylindrical body.

FIG. 5 shows a cross-section of a low-pressure mercury vapor discharge lamp according to the invention, wherein a hollow or solid cylindrical body 20 has four recesses, for accommodating two U-shaped discharge tubes, the legs of which are indicated by 21 and 22 and 23 and 24 respectively. The U-shaped discharge tubes can, for example, be electrically arranged in series with one stabilization element. In this manner a lamp is obtained which has a uniform light distribution.

I claim:

1. A low-pressure mercury vapor discharge lamp which comprises: at least one U-shaped discharge tube, and a generally cylindrical body having recesses, each discharge tube having first and second legs, each of said legs of said discharge tube being disposed at least partly in said recesses, said legs extending along the circumference of said body over an angle of at least 150°, said generally cylindrical body being transmissive to light, each of said U-shaped discharge tubes being disposed in substantially coplanar relationship with the axis of said generally cylindrical body.

2. A low-pressure mercury vapor discharge lamp as claimed in claim 1 wherein said generally cylindrical body consists of a transparent synthetic resin material.

3. A low-pressure mercury vapor discharge lamp as claimed in claim 1 or 2 wherein said generally cylindrical body is hollow.

4. A low-pressure mercury vapor discharge lamp which comprises: at least one U-shaped discharge tube, and a generally cylindrical body having recesses, each discharge tube having first and second legs, each of said legs of sad discharge tube being disposed at least partly in said recesses, said legs extending along the circumference of said body over an angle of at least 150°, said generally cylindrical body consisting of a synthetic resin material and being hollow, the wall of said recesses in said body facing said discharge tube including a reflective coating thereon.

* * * * *